US010082100B2

(12) United States Patent
Langschwager

(10) Patent No.: US 10,082,100 B2
(45) Date of Patent: Sep. 25, 2018

(54) CYLINDER HEAD AND ENGINE BLOCK CONFIGURATION

(71) Applicant: Caterpillar Motoren GmbH & Co. KG, Kiel (DE)

(72) Inventor: Ingo Langschwager, Stade (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 471 days.

(21) Appl. No.: 14/652,758

(22) PCT Filed: Dec. 17, 2013

(86) PCT No.: PCT/EP2013/003816
§ 371 (c)(1),
(2) Date: Jun. 16, 2015

(87) PCT Pub. No.: WO2014/095043
PCT Pub. Date: Jun. 26, 2014

(65) Prior Publication Data

US 2015/0330328 A1 Nov. 19, 2015

(30) Foreign Application Priority Data

Dec. 21, 2012 (EP) ..... 12198985

(51) Int. Cl.
*F02F 1/24* (2006.01)
*F02B 75/16* (2006.01)
*F02B 61/04* (2006.01)

(52) U.S. Cl.
CPC ..... *F02F 1/24* (2013.01); *F02B 75/16* (2013.01); *F02B 61/04* (2013.01)

(58) Field of Classification Search
CPC .. F02F 1/24; F02B 75/16; F02B 75/18; F02B 2275/02

(Continued)

(56) References Cited

U.S. PATENT DOCUMENTS 3,418,993 A * 12/1968 Scheiterlein ..... F02B 69/00 123/1 R
5,095,868 A * 3/1992 Brighigna ..... F02F 1/102 123/193.2

(Continued)

FOREIGN PATENT DOCUMENTS

CN 102 518 527 A 6/2012
DE 10 2005 02659 A1 12/2006

(Continued)

OTHER PUBLICATIONS

International Search Report dated Mar. 4, 2014, in Application No. PCT/EP2013/003816 by the European Patent Office (3 pages).

(Continued)

*Primary Examiner* — Grant Moubry

(57) ABSTRACT

A single-cylinder cylinder head is disclosed. The cylinder head may have a cylinder head body having a gas system side, a pushrod side opposing the gas system side, a circular cylinder closing face with a central injector opening, a pair of inlet openings, and a pair of outlet openings. The cylinder head may have a central injector recess extending through the cylinder head body to the central injector opening. Further, the cylinder head may have a gas inlet channel system and a gas outlet channel system. The cylinder head may also have a pushrod passage extending through the cylinder head body at the pushrod side. In addition, the cylinder head may have a plurality of cylinder mounting holes extending through the cylinder head body in an outer circumferential region of the single-cylinder cylinder head. The cylinder mounting holes may be non-equidistantly arranged around the central injector recess.

16 Claims, 7 Drawing Sheets

(58) Field of Classification Search
USPC ..... 123/193.5, 193.3
See application file for complete search history.

(56) References Cited

U.S. PATENT DOCUMENTS

| | | | | | |
|---|---|---|---|---|---|
| 5,983,849 | A * | 11/1999 | Wangen | F01L 1/14 | 123/193.3 |
| 7,322,320 | B2 | 1/2008 | Sugano | | |
| 7,895,992 | B2 * | 3/2011 | Diggs | F01L 1/182 | 123/193.5 |
| 8,887,680 | B2 * | 11/2014 | Hayman | F02B 75/22 | 123/90.27 |
| 2003/0010300 | A1 * | 1/2003 | Stretch | F01L 1/0532 | 123/90.15 |
| 2011/0036313 | A1 * | 2/2011 | Riley | F01L 1/38 | 123/41.72 |

FOREIGN PATENT DOCUMENTS

| | | | | |
|---|---|---|---|---|
| EP | 2131031 | A1 * | 12/2009 | F02F 1/10 |
| JP | H06-207565 | A | 7/1884 | |
| JP | S57-10746 | A | 1/1982 | |
| JP | 58-202346 | A | 11/1983 | |
| JP | H04-103821 | | 4/1992 | |
| JP | 2004-176550 | A | 6/2004 | |
| JP | 4222194 | B2 | 6/2005 | |
| JP | 2006-097579 | A | 4/2006 | |

OTHER PUBLICATIONS

European Search Report dated Jun. 18, 2013 in Application No. EP 12198985 by the European Patent Office (2 pages).

* cited by examiner

CYLINDER HEAD AND ENGINE BLOCK CONFIGURATION

CLAIM FOR PRIORITY

This application is a U.S. National Phase entry under 35 U.S.C. § 371 from PCT International Application No. PCT/EP2013/003816, filed on Dec. 17, 2013, which claims benefit of priority of European Patent Application No. 12198985.9, filed on Dec. 21, 2012, all of which are incorporated herein by reference.

TECHNICAL FIELD

The present disclosure generally relates to a cylinder head and an engine block, and more particularly to a single-cylinder cylinder head and an engine block for large internal combustion engines.

BACKGROUND

Cylinder heads are mounted onto cylinders for defining a combustion chamber between a cylinder closing face of the cylinder head, a cylinder liner, and a moving piston. Generally, cylinder heads for mounting on cylinders are either adapted as single-cylinder cylinder heads or multi-cylinder cylinder heads. Single-cylinder cylinder heads are mounted onto a single cylinder (for example, of a multi-cylinder block), whereas multi-cylinder cylinder heads are mounted as a single part onto a plurality of neighboring cylinders (for example, of a multi-cylinder block).

Cylinder heads of large internal combustion engines accommodate a plurality of various components such as inlet valves, outlet valves, gas inlet and outlet channel system, injector(s), pushrods, and cooling channels. Due to the plurality of components, package restrictions arise as positioning of one component within the cylinder head may affect the positioning of the remaining components.

The present disclosure is directed, at least in part, to improving or overcoming one or more aspects of prior systems.

SUMMARY OF THE DISCLOSURE

In one aspect of the present disclosure, a single-cylinder cylinder head for mounting onto one of multiple cylinder sections of a large internal combustion engine may comprise a cylinder head body having a gas system side, a pushrod side opposing the gas system side and a circular cylinder closing face with a central injector opening, a pair of inlet openings, and a pair of outlet openings, wherein the central injector opening may be disposed centrally in the circular cylinder closing face and a central axis passes through the central injector opening from the gas system side to the pushrod side, and the pair of outlet openings and the pair of inlet openings are arranged on opposing sides with respect to the central axis. The single-cylinder cylinder head may further comprise a central injector recess extending through the cylinder head body to the central injector opening, a gas inlet channel system extending from the gas system side through the cylinder head body to the pair of inlet openings, a gas outlet channel system extending from the pair of outlet openings through the cylinder head body to the gas system side, a pushrod passage extending through the cylinder head body at the pushrod side, and in total exactly five cylinder mounting holes extending through the cylinder head body in an outer circumferential region of the cylinder head, wherein the in total exactly five cylinder mounting holes are non-equidistantly arranged around the central injector recess.

In another aspect of the present disclosure, an engine block for a large internal combustion engine may comprise a plurality of cylinder sections, each cylinder section having in total exactly five cylinder head mounting structures arranged around a cylinder bore for mounting of a single-cylinder cylinder head thereon, wherein the in total exactly five cylinder head mounting structures of each cylinder section are non-equidistantly arranged.

In yet another aspect of the present disclosure, a large internal combustion engine may comprise an engine block as exemplary disclosed herein, with a plurality of cylinder sections, each cylinder section having in total exactly five cylinder head mounting holes. The large internal combustion engine may further comprise a plurality of single-cylinder cylinder heads as exemplary disclosed herein, wherein each single-cylinder cylinder head is mounted onto a respective cylinder section of the engine block via in total exactly five mounting members connecting the in total exactly five cylinder mounting holes of a respective single-cylinder cylinder head to the in total exactly five cylinder head mounting structures of a respective cylinder section of the engine block.

Other features and aspects of this disclosure will be apparent from the following description and the accompanying drawings.

DETAILED DESCRIPTION

Figure 1:
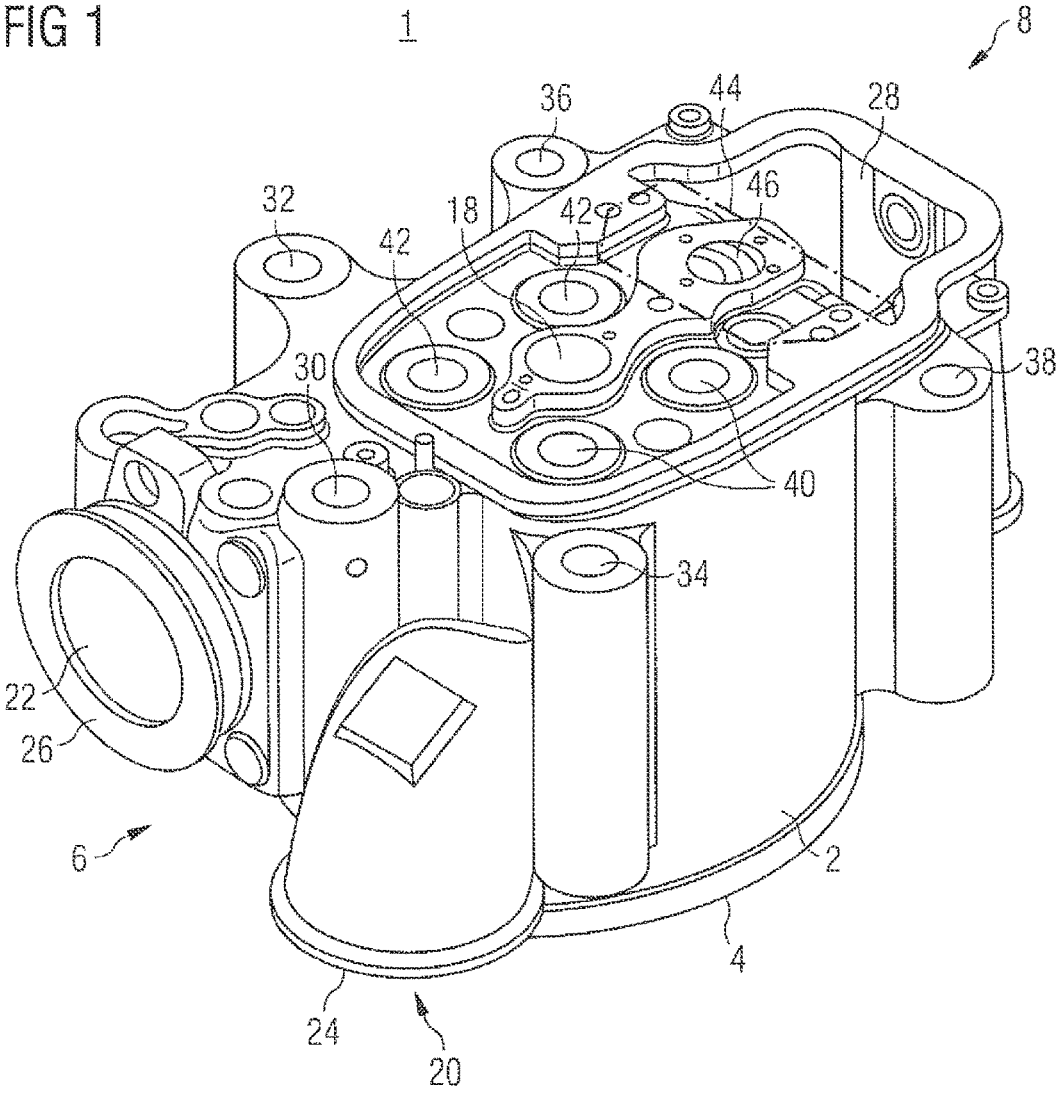
FIG. 1 is an isometric view of an exemplary cylinder head.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure may be based in part on the realization that variations of a mounting hole arrangement of a cylinder head may facilitate an improved cylinder head configuration in terms of, for example, flow optimized charge air/exhaust gas channel design, stiffened structure, additional space for additional components, package requirements, and/or close side by side arrangement of neighboring single-cylinder cylinder heads.

Accordingly, a single-cylinder cylinder head configuration is disclosed that comprises a cylinder mounting hole configuration which pays attention on package restrictions while improving the package situation.

Figure 2:
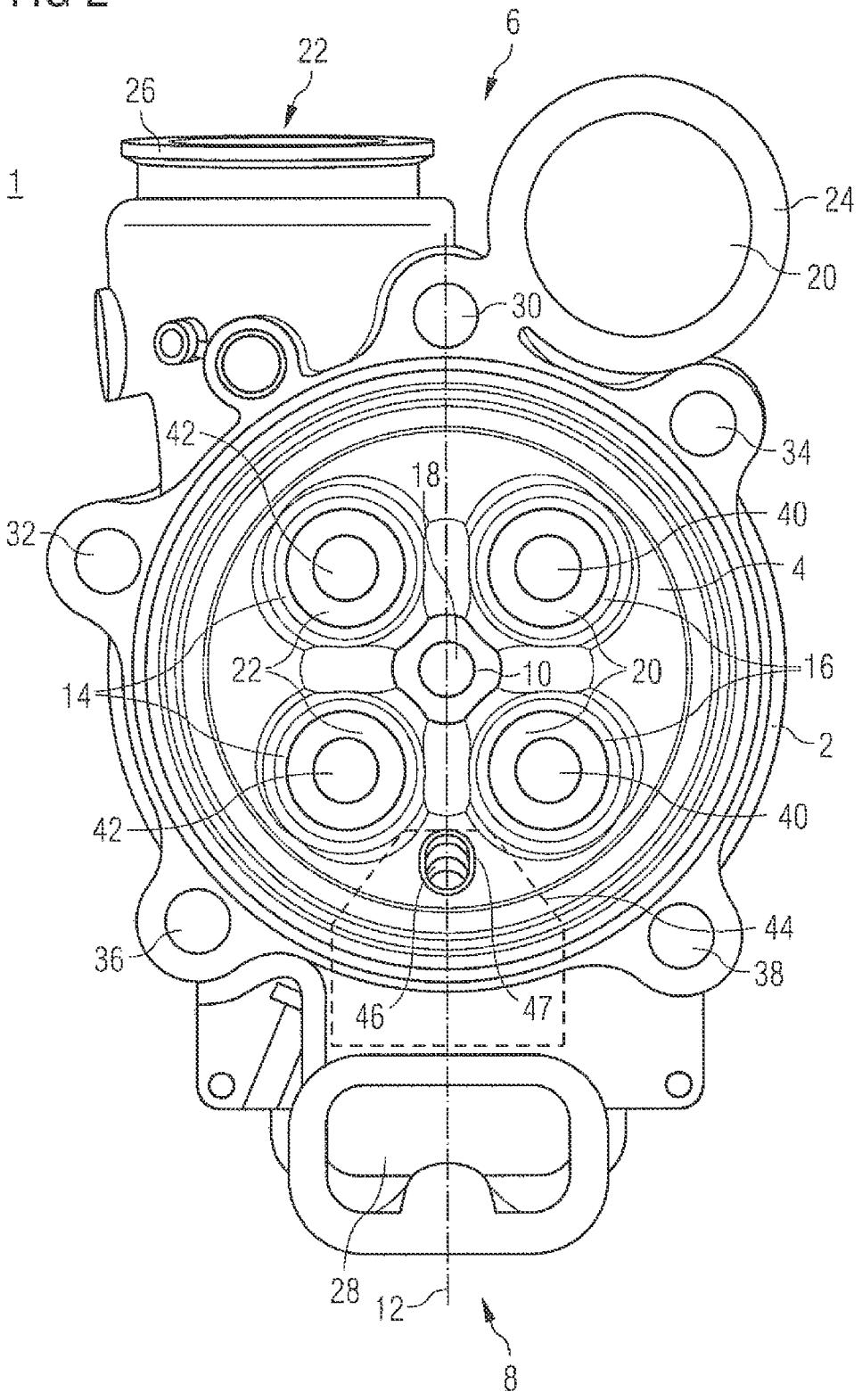
FIG. 2 is a bottom view of the exemplary cylinder head of FIG. 1.

Referring now to FIGS. 1 and 2, an isometric view and a bottom view of an exemplary cylinder head is shown.

Cylinder head 1 is adapted as a single-cylinder cylinder head for covering exactly one cylinder of a plurality of cylinders of a large internal combustion engine. Cylinder head 1 comprises a cylinder head body 2.

Cylinder head body 2 has a circular cylinder closing face 4 which faces a piston in a mounted state of cylinder head 1 on one cylinder to define a combustion chamber between circular cylinder closing face 4, a cylinder liner and a top of a moving piston. Cylinder head body 2 has a gas system side 6 and a pushrod side 8 which opposes gas system side 6.

Circular cylinder closing face 4 includes a central injector opening 10 disposed centrally in the circular cylinder closing face 4. A central axis 12 passes through central injector opening 10 from gas system side 6 to pushrod side 8.

A pair of outlet openings 14 and a pair of inlet openings 16 are disposed in circular cylinder closing face 4, and arranged on opposing sides with respect to central axis 12.

Each opening of both the pair of inlet openings 16 and the pair of outlet openings 14 includes a valve seat providing a sealed connection with a respective valve in a mounted state if the respective valve is in a closed position.

Cylinder head 1 further comprises a central injector recess 18, a gas inlet channel system 20 and a gas outlet channel system 22.

Central injector recess 18 extends from a top of cylinder head 1 through cylinder head body 2 to central injector opening 10. Adapted to receive an injector (not shown), central injector recess 18 may provide an injector seat and may be connected to and/or surrounded by cooling channels. Alternatively, cylinder head 1 may comprise a prechamber.

Gas inlet channel system 20 extends from an inlet channel system flange section 24 at gas system side 6 through cylinder head body 2 to the pair of inlet openings 16. In the shown configuration, gas inlet channel system 20 is formed by a common inlet port extending from inlet channel flange section 24 branching into two limbs within cylinder head body 2, each limb ending in a respective one of the pair of inlet openings 16. Inlet channel flange section 24 may be adapted for fluidly connecting to a charge air manifold.

Gas outlet channel system 22 extends from the pair of outlet openings 14 through cylinder head body 2 to an outlet channel system flange section 26 at gas system side 6. Likewise to gas inlet channel system 20, gas outlet channel system 22 is formed by two outlet limbs extending from the pair of outlet openings 14 and joining within cylinder head body 2 to a common outlet port ending in gas outlet channel flange section 26. Outlet channel flange section 26 may be adapted for fluidly connecting to an outlet manifold of an exhaust gas system.

At pushrod side 8, a pushrod passage 28 extends through cylinder head body 2. In a mounted state of cylinder head 1, a pair of pushrods may extend through pushrod passage 28 for actuation of a pair of inlet and a pair of outlet valves moveably arranged in gas inlet channel system 20 and gas outlet channel system 22, respectively.

In total exactly five cylinder mounting holes 30, 32, 34, 36, 38 extend through cylinder head body 2 in an outer circumferential region of cylinder head 1. A first cylinder mounting hole 30 is disposed between gas inlet channel system 20 and gas outlet channel system 22 at gas system side 6. A second cylinder mounting hole 32, and a third cylinder mounting hole 34 are disposed on opposing sides with respect to central axis 12 at gas system side 6. Second cylinder mounting hole 32 is arranged closer to gas outlet channel system 22 than third cylinder mounting hole 34, whereas third cylinder mounting hole 34 is arranged closer to gas inlet channel system 20 than second cylinder mounting hole 32. In addition, a fourth cylinder mounting hole 36 and a fifth cylinder mounting hole 38 are disposed on opposing sides with respect to central axis 12, yet at pushrod side 14.

Each of the in total exactly five cylinder mounting holes 30, 32, 34, 36, 38 may have a cylinder mounting hole diameter within the range from 30 mm to 60 mm. In some embodiments, at least one cylinder mounting hole may have a different cylinder mounting hole diameter than at least one other cylinder mounting hole. In addition, each of the in total exactly five cylinder mounting holes 30, 32, 34, 36, 38 may be adapted to receive a head bolt or a head stud for mounting cylinder head 1 onto one of a series of cylinders.

In a mounted state, a pair of inlet valves is moveably arranged within a pair of inlet valve recesses 40 extending from a top of cylinder head 1 through cylinder head body 2 into gas inlet channel system 20. Similarly, a pair of outlet valves is moveably arranged within a pair of outlet valve recesses 42 extending form a top of cylinder head 1 through cylinder head body 2 into gas outlet channel system 22.

As can be seen in FIGS. 1 and 2, cylinder head 1 comprises additional recesses and connections which do not include a reference numeral for purposes of clarity. For example, cylinder head 1 may comprise cover mounting holes for mounting of a cylinder head cover (not shown) onto cylinder head 1, and/or connections for a cooling system that may guide cooling liquid into and out of cylinder head body 2 for cooling various components such as an injector in central injector recess 18, and gas outlet channel system 22.

By arranging fourth cylinder mounting hole 36 and fifth cylinder mounting hole 38 spaced from each other, and on opposing sides with respect to central axis 12, a component accommodation space 44 is provided between both cylinder mounting holes 36 and 38. Specifically, component accommodation space 44 is provided between a section of gas outlet channel system 22 at pushrod side 8, a section of gas inlet channel system 20 at pushrod side 8, fifth cylinder mounting hole 38, pushrod passage 28, and fourth cylinder mounting hole 36.

Component accommodation space 44 provides access to the combustion chamber. Thus, a component such as a valve, a sensor, and/or an injector may be mounted in a respective recess extending through component accommodation space 44 to a component opening 47 in circular cylinder closing face 4. For example, in the configuration shown in FIGS. 1 and 2, a component recess 46 is provided within component accommodation space 44, for example, for mounting a starter valve.

Due to the position of component accommodation space 44, the same provides an easy access to itself, for example, for supply lines, and control cables. That provided component accommodation space 44 may be in particular valuable, as other possible locations for a component accommodation space may not provide a good access to themselves as the access may be at least partly blocked, by, for example, a gas inlet channel system and a gas outlet channel system at a gas side, or a closely arranged neighboring single-cylinder cylinder head mounted onto a neighboring cylinder.

Alternatively or additionally, a fuel channel system may be at least partially provided within component accommodation space 44.

Figure 3:
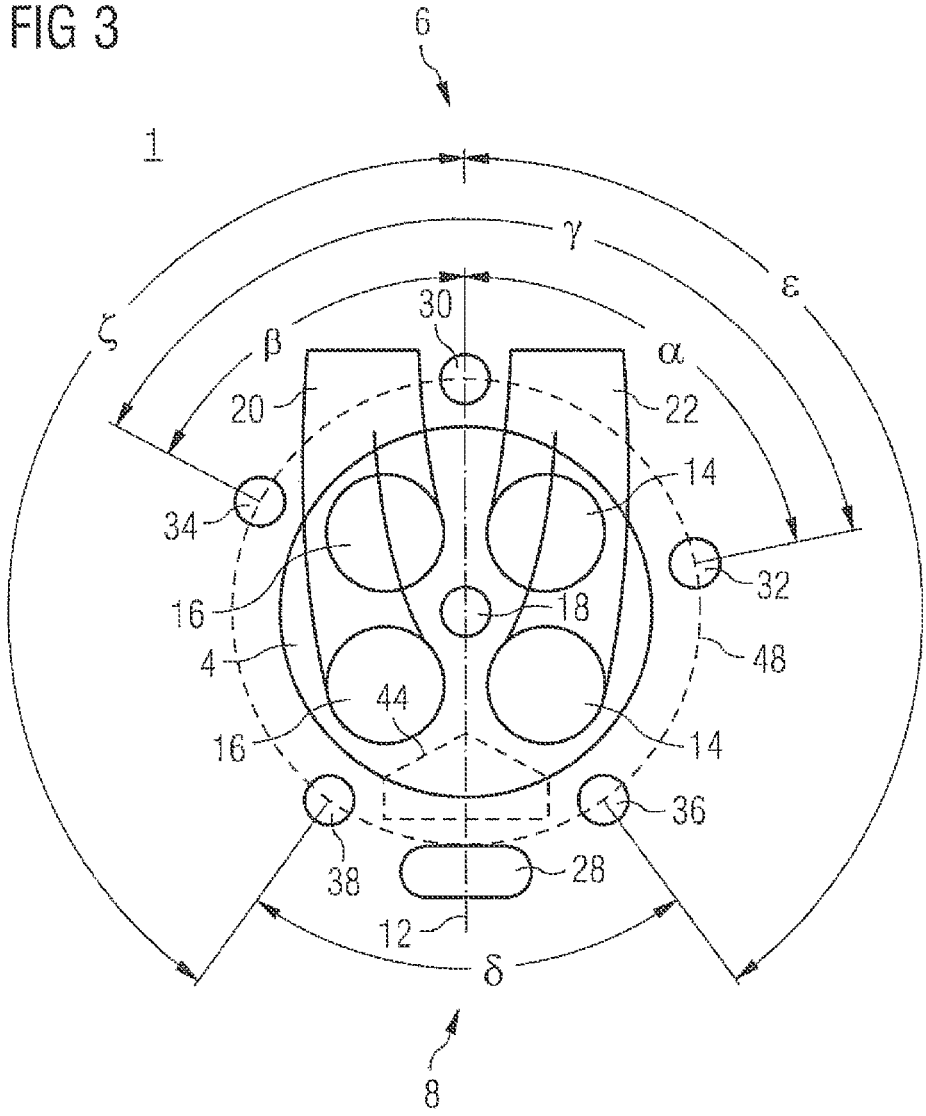
FIG. 3 is a schematic drawing of an exemplary cylinder head.

Turning to FIG. 3, a schematic top view of exemplary cylinder head 1 is shown to illustrate an exemplary arrangement of the cylinder mounting holes.

In the shown configuration, the in total exactly five cylinder mounting holes 30, 32, 34, 36, 38 are arranged non-equidistantly on circle 48. However, in anticipation of the embodiment shown in FIG. 5, the in total exactly five cylinder mounting holes 30, 32, 34, 36, 38 may be alternatively or additionally arranged non-equidistantly with respect to central injector recess 18.

Accordingly, non-equidistantly as used herein may have two aspects depending on the context. Firstly, the in total exactly five cylinder mounting holes 30, 32, 34, 36, 38 are arranged non-equidistantly with respect to each other as shown, for example, in FIG. 3. In other words, at least one distance between a pair of neighboring cylinder mounting holes is unequal to at least one other distance between a remaining pair of neighboring cylinder mounting holes. Neighboring as used herein means the next cylinder mounting hole in a clockwise or anticlockwise direction. Secondly, the in total exactly five cylinder mounting holes 30, 32, 34, 36, 38 are arranged non-equidistantly with respect to central injector recess 18. In other words, at least one distance between a cylinder mounting hole and central injector recess 18 is unequal to at least one distance between another cylinder mounting hole and central injector recess 18. Naturally, both aspects may be combinable.

Specifically, in the shown configuration of FIG. 3, an arc angle $\alpha$ with respect to the central injector recess 18 at gas system side 6 between first cylinder mounting hole 30 and second cylinder mounting hole 32 is greater than an arc angle $\beta$ with respect to central injector recess 18 at gas system side 6 between first cylinder mounting hole 30 and third cylinder mounting hole 34. For example, arc angle $\alpha$ between first cylinder mounting hole 30 and second cylinder mounting hole 32 may be within a range from 45° to 90°. Additionally, arc angle $\beta$ between first cylinder mounting hole 30 and third cylinder mounting hole 34 may be within a range from 45° to 90°.

Additionally or alternatively, an arc angle $\gamma$ with respect to central injector recess 18 at gas system side 6 between second cylinder mounting hole 32 and third cylinder mounting hole 34 is greater than an arc angle $\delta$ with respect to central injector recess 18 at pushrod side 8 between fourth cylinder mounting hole 36 and fifth cylinder mounting hole 38. For instance, arc angle $\gamma$ between second cylinder mounting hole 32 and third cylinder mounting hole 34 may be within a range from 90° to 180°, and arc angle $\delta$ between fourth cylinder mounting hole 36 and fifth cylinder mounting hole 38 may be within a range from 20° to 180°.

In some embodiments, an arc angle $\varepsilon$ with respect to central injector recess 18 from gas system side 6 to pushrod side 8 between second cylinder mounting hole 32 and fourth cylinder mounting hole 36 is greater than an arc angle $\zeta$ with respect to central injector recess 18 from pushrod side 8 to gas system side 6 between fifth cylinder mounting hole 38 and second cylinder mounting hole 34.

In some embodiments, first cylinder mounting hole 30, second cylinder mounting hole 32 and third cylinder mounting hole 34 may be positioned such that a channel diameter of gas inlet channel system 20 and/or a channel diameter of gas outlet channel system 22 are unaffected. On the contrary, prior art solutions having more than five cylinder mounting holes may affect a channel diameter of an inlet channel system and/or a channel diameter of an outer channel system. Affected as used herein means that a channel diameter is decreased which may result in deteriorated flow characteristics provided by the respective channel system leading to, for example, an increased pressure drop. In other words, in prior art solutions, a course of the inlet channel system and/or a course of the outlet channel system may be affected in a way that a dent is included in the respective course as a minimum wall thickness between mounting hole and inner channel wall of a respective channel system may be not undercut.

Additionally, first cylinder mounting hole 30, second cylinder mounting hole 32 and third cylinder mounting hole 34 may be positioned such that the respective two limbs of gas inlet channel system 20 and/or gas outlet channel system 22 combine into one channel close to gas system side 6 such that each channel can be designed flow optimized for at least a distance that ensures the required flow configuration at, for example, the pair of inlet openings 16. For example, additional walls within cylinder head 1 may be provided and shaped to increase stiffness of cylinder head 1.

Figure 4:
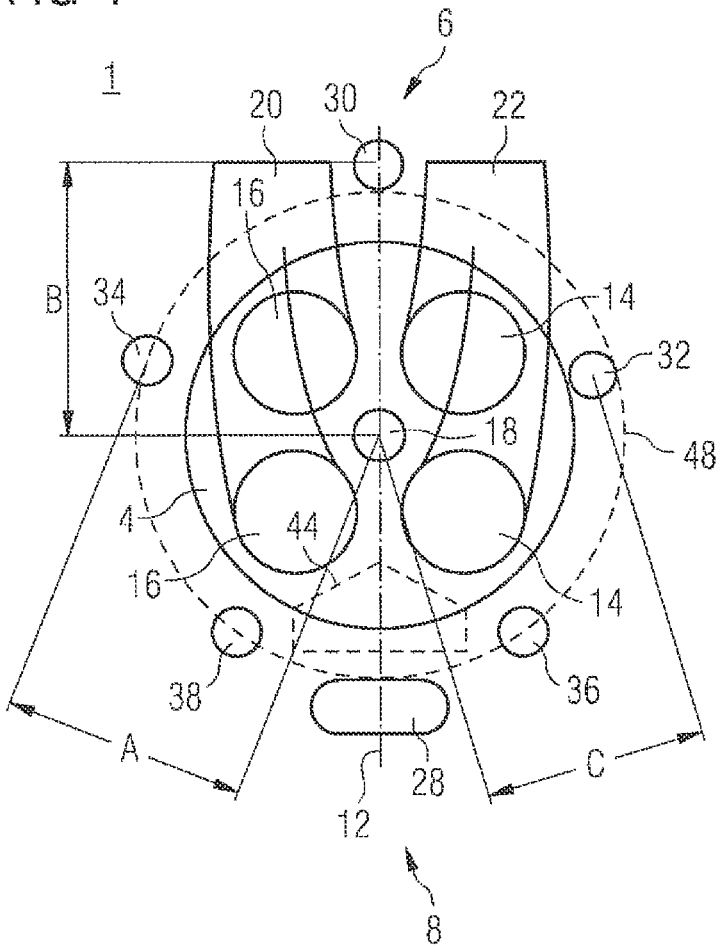
FIG. 4 is a schematic drawing of another exemplary cylinder head.

Turning to FIG. 4, another exemplary arrangement of the in total exactly five cylinder mounting holes 30, 32, 34, 36, 38 is shown.

As already mentioned before, in the shown configuration the in total exactly five cylinder mounting holes 30, 32, 34, 36, 38 are, in particular, arranged non-equidistantly with respect to central injector recess 18.

For example, as shown in the configuration of FIG. 4, a distance A from third cylinder mounting hole 34 to central injector recess 18 is greater than a distance C from second cylinder mounting hole 32 to central injector recess 18. Additionally, a distance B from first cylinder mounting hole 30 to central injector recess 18 is greater than distance A and distance C.

However, one skilled in the art will appreciate that various other configurations of non-equidistant arrangements exist in terms of the mentioned first and second aspects exist, which may facilitate, for example, flow optimized charge air/exhaust gas channel design, stiffened structure, package requirements, and/or close side by side arrangement of neighboring single-cylinder cylinder heads, and provision of an accessible component accommodation space which in turn provides access to the combustion chamber for at least one component provided therein.

Figure 5:
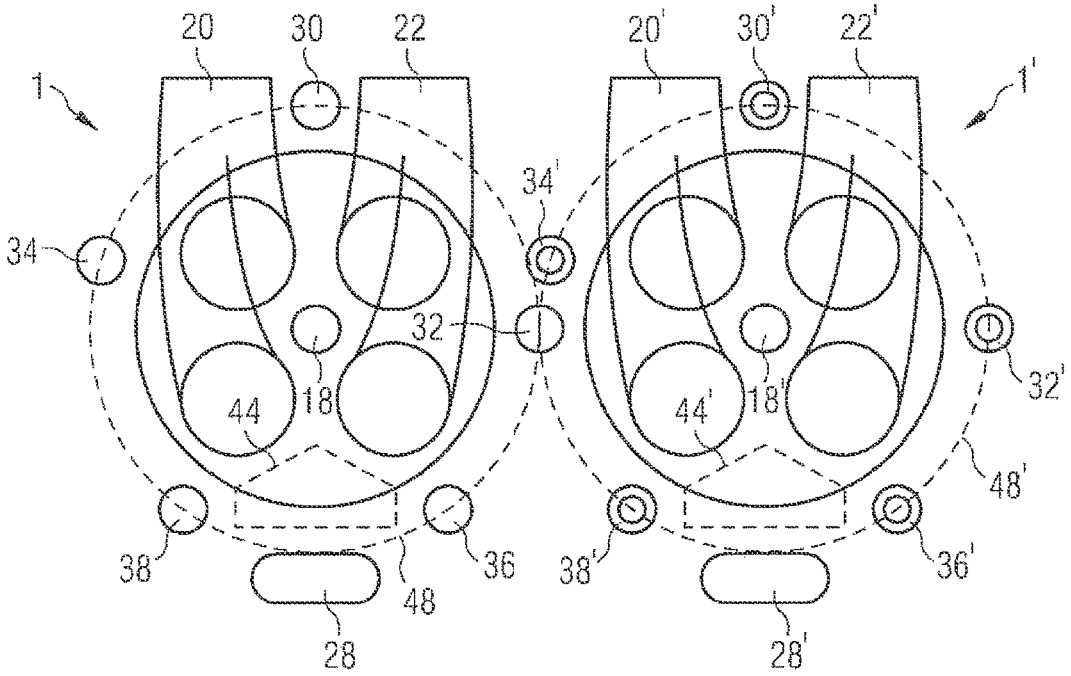
FIG. 5 is a schematic drawing of two neighboring exemplary cylinder heads.

Referring now to FIG. 5, two neighboring exemplary cylinder heads 1, 1' arranged side by side are shown. For purposes of clarity the close arrangement illustrated in FIGS. 5 to 7 (FIG. 7 showing a respective close arrangement of cylinder head mounting structures in an engine block) may be overemphasized.

Due to aforementioned non-equidistant arrangement of mounting holes, a close arrangement of two neighboring cylinder heads may be facilitated. That is, cylinder mounting holes 30, 32, 34, 36, 38 of first cylinder head 1 and cylinder mounting holes 30', 32', 34', 36', 38' of second cylinder head 1 are arranged to mesh into each other.

In the shown configuration, as an arc angle between first cylinder mounting hole 30 and second cylinder mounting hole 32 (arc angle $\alpha$ with respect to FIG. 3) is greater than an arc angle between first mounting hole 30 and third cylinder mounting hole 34 (arc angle $\beta$ with respect to FIG. 3), a close arrangement of neighboring cylinder heads 1 and 1' is facilitated.

Close arrangement as used herein means closer than is possible if having equidistantly arranged cylinder mounting holes with a cylinder mounting hole between gas inlet channel system and gas outlet channel system. For example, in the case of arrangement of cylinder mounting holes 30, 32, 34, 36, 38 on circle 48, circles 48 of neighboring cylinder heads 1 and 1' may intersect each other, or may touch each other.

Figure 6:
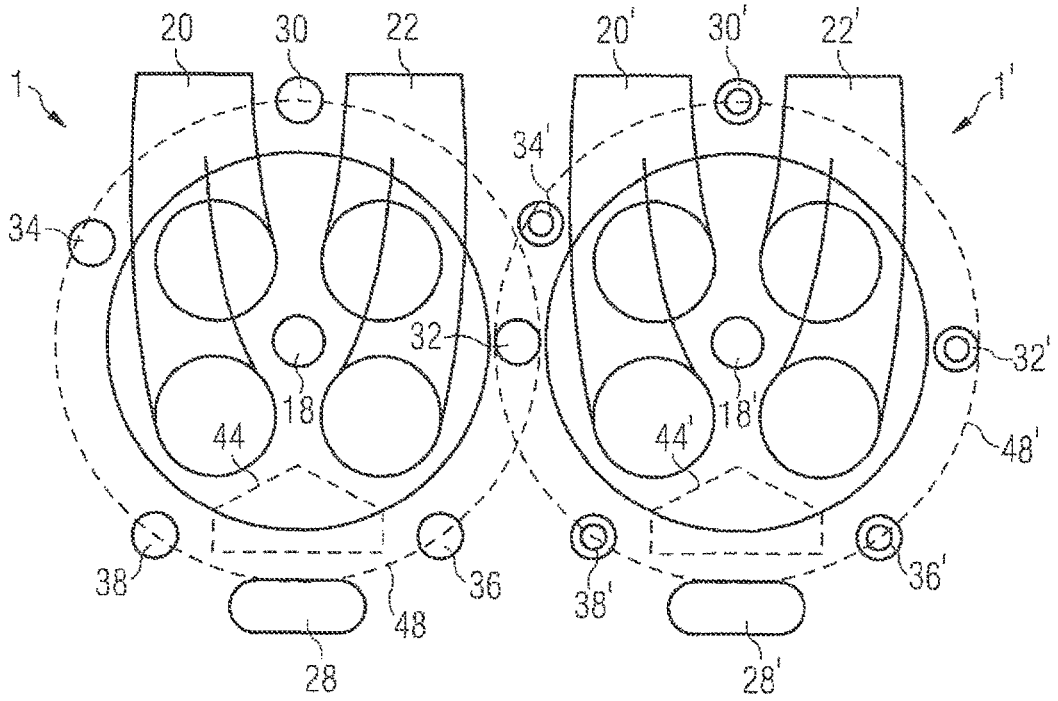
FIG. 6 is a schematic drawing of two neighboring other exemplary cylinder heads.
Figure 7:
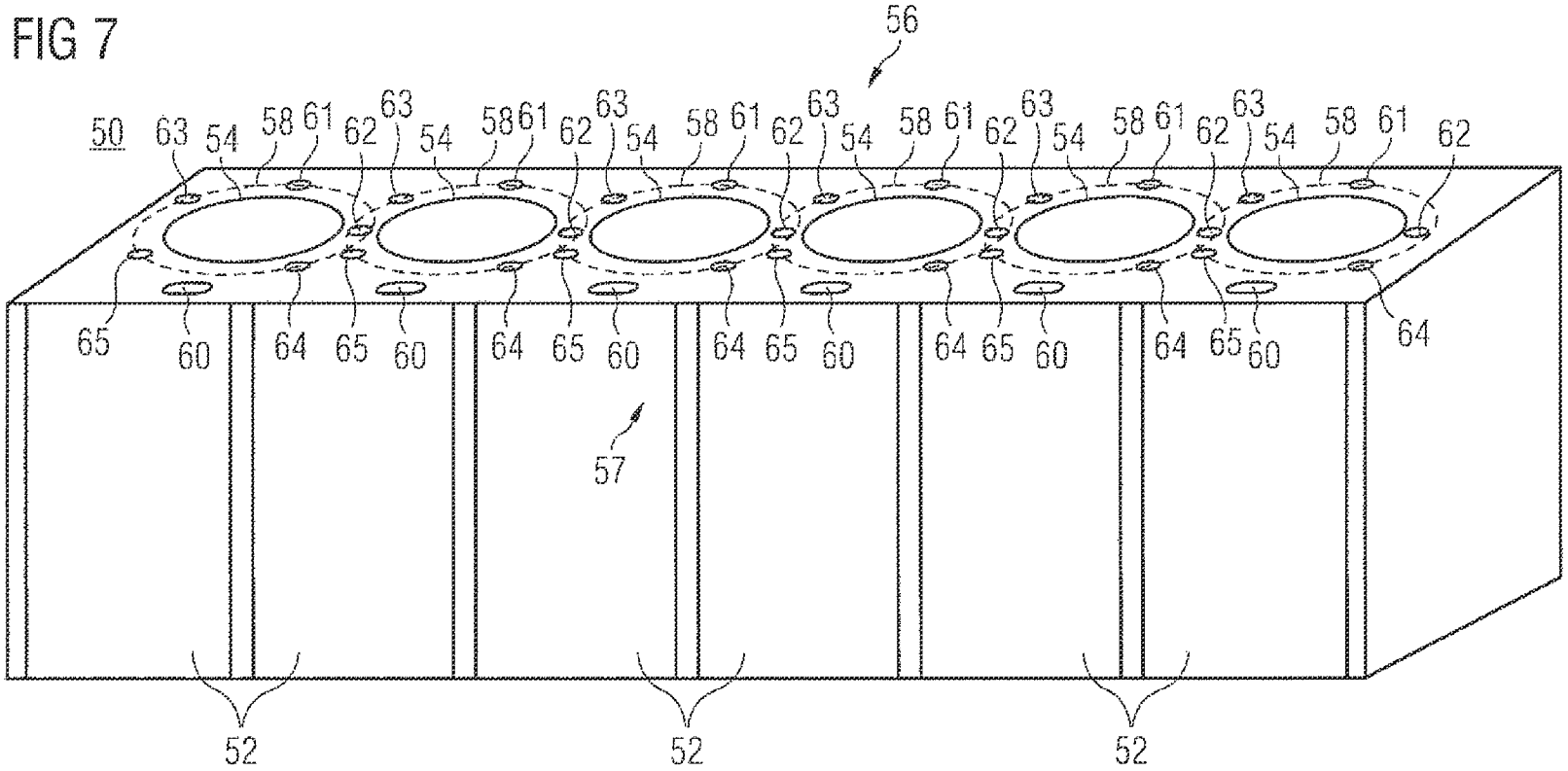
FIG. 7 is a schematic drawing of an exemplary engine block of a large internal combustion engine.

In FIG. 6, another exemplary arrangement of two neighboring cylinder heads is shown.

In the shown configuration, a combination of non-equidistant arrangement of cylinder mounting holes with respect to each other and with respect to central injector recess is provided.

The close arrangement of neighboring cylinder heads 1 and 1' is, in particular, facilitated due to a reduced distance between second cylinder mounting hole 32 and central injector recess 18 as well as the non-equidistant arrangement between neighboring cylinder mounting holes 30, 32, 34, 36, 38.

Each single-cylinder cylinder head 1 is mounted onto one of a series of cylinders of an exemplary engine block as shown in FIG. 7.

Engine block 50 comprises a plurality of cylinder sections 52, each cylinder section 52 comprising a cylinder bore 54. Engine block 50 is adapted as a large engine block for a large internal engine (not shown).

Each cylinder section 52 has in total exactly five cylinder head mounting structures 61, 62, 63, 64, 65 arranged non-equidistantly around a respective cylinder bore 54. Non-equidistant as used herein means, similar to the arrangement of cylinder mounting holes 30, 32, 34, 36, 38 of cylinder head 1, non-equidistant with respect to each other and with respect to central cylinder bore 54. Accordingly, the in total exactly five cylinder head mounting structures 61, 62, 63, 64, 65 of neighboring cylinder sections may be arranged to mesh into each other as shown to facilitate a close arrangement of neighboring cylinder bores 54. The in total exactly five cylinder head mounting structures 61, 62, 63, 64, 65 may be configured, for example, as cylinder head mounting holes.

The in total exactly five cylinder head mounting structures 61, 62, 63, 64, 65 are adapted for mounting single-cylinder cylinder head 1, and are adapted to receive a head bolt or head stud for mounting of a single-cylinder cylinder head thereon. For example, cylinder head mounting structures 61, 62, 63, 64, 65 may have a cylinder head mounting structures diameter within the range from 30 mm to 60 mm.

Engine block 50 includes a gas system side 56 and a pushrod side 57 opposing gas system side 56. For each cylinder section 52, a first cylinder head mounting structure 61, a second cylinder head mounting structure 62 and a third cylinder head mounting structure 63 are disposed at gas system side 56. The first cylinder head mounting structure 61 is arranged between second cylinder head mounting structure 62 and third cylinder head mounting structure 63. A fourth cylinder head mounting structure 64 and a fifth cylinder head mounting structure 65 are disposed at pushrod side 57.

In addition, engine block 50 may further comprise a plurality of engine block pushrod passages 60 at pushrod side 57.

With respect to the arrangement of the cylinder head mounting structure, it is referred to the discussion of the cylinder mounting holes above, for example, in connection with FIGS. 3 to 6. Accordingly, angles and distances are not explicitly shown in FIG. 7 for purpose of clarity of the drawing.

For example, similar to the arrangement of cylinder mounting holes 30, 32, 34, 36, 38 in cylinder head 1, arc angles with respect to cylinder bore 54 between the five cylinder head mounting structure 61, 62, 63, 64, 65 may be unequal. For example, an arc angle with respect to cylinder bore 54 at gas system side 56 between first cylinder head mounting structure 61 and second cylinder head mounting structure 62 may be greater than an arc angle with respect to cylinder bore 54 at gas system side 56 between first cylinder head mounting structure 61 and third cylinder head mounting structure 63.

Additionally or alternatively, an arc angle with respect to cylinder bore 54 at gas system side 56 between second cylinder head mounting structure 62 and third cylinder head mounting structure 63 may be greater than an arc angle with respect to cylinder bore 54 at pushrod side 57 between fourth cylinder head mounting structure 64 and fifth cylinder head mounting structure 65. An arc angle with respect to cylinder bore 54 from gas system side 56 to pushrod side 57 between second cylinder head mounting structure 62 and fourth cylinder head mounting structure 64 may be greater than an arc angle with respect to cylinder bore 54 from pushrod side 57 to gas system side 56 between fifth cylinder head mounting structure 65 and second cylinder head mounting structure 62.

In some embodiments, an arc angle with respect to cylinder bore 54 at gas system side 56 between first cylinder head mounting structure 61 and second cylinder head mounting structure 62 may be within a range from 45° to 90°. Additionally or alternatively, an arc angle with respect to cylinder bore 54 at gas system side 56 between first cylinder head mounting structure 61 and third cylinder head mounting structure 63 may be within a range from 45° to 90°.

In some embodiments, an arc angle with respect to cylinder bore 54 at gas system side 56 between the second cylinder head mounting structure 62 and the third cylinder head mounting structure 63 may be within a range from 90° to 180°. Additionally or alternatively, an arc angle with respect to cylinder bore 54 at pushrod side 57 between fourth cylinder head mounting structure 64 and fifth cylinder head mounting structure 65 may be within a range from 20° to 180°.

As used herein, the terms "with respect to central injector recess 18" and "with respect to cylinder bore 54" mean with respect to a center point of central injector recess 18 and a center point of cylinder bore 54, respectively.

Furthermore, as used herein "pushrod side" and "gas system side" relate to respective halves of single-cylinder cylinder head 1 and engine block 50, respectively. In other words, cylinder head body 2 comprises a pushrod side half and a gas system side half. Likewise, engine block 50 comprises a pushrod side half and a gas system side half.

INDUSTRIAL APPLICABILITY

Single-cylinder cylinder head 1, engine block 50, and large internal combustion engine comprising a plurality of cylinder heads 1 mounted onto a plurality of cylinders of engine block 50 may be used, for example, in marine ships or vessels, in power plants or offshore applications. In particular, the disclosed structures may be used in applications having increased package requirements as described before.

Generally, aforementioned large internal combustion engine may include features not shown, such as air systems, exhaust gas systems, cooling systems, peripheries, drivetrain components, etc. Furthermore, large internal combustion engine may be of any size, with any number of cylinders, and in any configuration (e.g., "V," in-line, radial, etc.). Still further, large internal combustion engine may be used to power any machine or other device, including locomotive applications, on-highway trucks or vehicles, off-highway trucks or machines, earth moving equipment, generators, aerospace applications, marine applications, offshore applications, pumps, stationary equipment, or other engine powered applications.

In a further aspect of the present disclosure, a single-cylinder cylinder head for mounting onto one of a series of cylinders of a large internal combustion engine may comprise a cylinder head body having a gas system side and a pushrod side opposing the gas system side, and having a circular cylinder closing face with a central injector opening, a pair of inlet openings, and a pair of outlet openings, wherein the central injector opening is disposed centrally in the circular cylinder closing face and a central axis passes through the central injector opening from the gas system side to the pushrod side, and the pair of outlet openings and the pair of inlet openings are arranged on opposing sides with respect to the central axis, a central injector recess extending through the cylinder head body to the central injector opening, a gas inlet channel system extending from the gas system side through the cylinder head body to the pair of inlet openings, a gas outlet channel system extending from the pair of outlet openings through the cylinder head body to the gas system side, a pushrod passage extending through the cylinder head body at the pushrod side, in total exactly five cylinder mounting holes extending through the cylinder head body in an outer circumferential region of the cylinder head, wherein a first cylinder mounting hole is disposed between the gas inlet channel system and the gas outlet channel system at the gas system side, a second cylinder mounting hole and a third cylinder mounting hole disposed on opposing sides with respect to the central axis at the gas system side, and a fourth cylinder mounting hole and a fifth cylinder mounting hole disposed on opposing sides with respect to the central axis at the pushrod side such that a component accommodation space is provided at the pushrod side between the pushrod passage, the gas inlet channel system, the gas outlet channel system, the fourth cylinder mounting hole, and the fifth cylinder mounting hole.

In the aforementioned aspect, the cylinder mounting holes may be arranged equidistantly or non-equidistantly around the central injector recess, for example, on a circle around the central injector recess.

Additionally or alternatively, the single-cylinder cylinder head may comprise at least one component recess provided in the component accommodation space and connected to a component opening in the circular cylinder closing face, in particular, for mounting a sensor, a valve, and/or an injector.

Additionally or alternatively, a fuel channel system may be at least partially provided within the component accommodation space.

Although the preferred embodiments of this invention have been described herein, improvements and modifications may be incorporated without departing from the scope of the following claims.

The invention claimed is:

1. A single-cylinder cylinder head for mounting onto one of multiple cylinder sections of an engine, comprising:

a cylinder head body having a gas system side, a pushrod side opposing the gas system side, and a circular cylinder closing face with a central injector opening, a pair of inlet openings, and a pair of outlet openings, wherein the central injector opening is disposed centrally in the circular cylinder closing face and a central axis passes through the central injector opening from the gas system side to the pushrod side, and the pair of outlet openings and the pair of inlet openings are arranged on opposing sides with respect to the central axis;

a central injector recess extending through the cylinder head body to the central injector opening;

a gas inlet channel system extending from the gas system side through the cylinder head body to the pair of inlet openings;

a gas outlet channel system extending from the pair of outlet openings through the cylinder head body to the gas system side;

a pushrod passage extending through the cylinder head body at the pushrod side; and in total exactly five cylinder mounting holes extending through the cylinder head body in an outer circumferential region of the single-cylinder cylinder head, wherein the cylinder mounting holes are non-equidistantly arranged around the central injector recess, wherein the in total exactly five cylinder mounting holes includes a first cylinder mounting hole, a second cylinder mounting hole, a third cylinder mounting hole, a fourth cylinder mounting hole, and a fifth cylinder mounting hole such that the first cylinder mounting hole is disposed between the gas inlet channel system and the gas outlet channel system at the gas system side, the second cylinder mounting hole and the third cylinder mounting hole are disposed on opposing sides with respect to the central axis at the gas system side, and the fourth cylinder mounting hole and the fifth cylinder mounting hole are disposed on opposing sides with respect to the central axis at the pushrod side.

2. The single-cylinder cylinder head of claim 1, wherein the cylinder mounting holes are non-equidistantly arranged with respect to each other, and the cylinder mounting holes are non-equidistantly arranged with respect to the central injector recess.

3. The single-cylinder cylinder head of claim 1, wherein an arc angle ($\alpha$) with respect to the central injector recess at the gas system side between the first cylinder mounting hole and the second cylinder mounting hole is greater than an arc angle ($\beta$) with respect to the central injector recess at the gas system side between the first cylinder mounting hole and the third cylinder mounting hole.

4. The single-cylinder cylinder head of claim 3, wherein the arc angle (a) ranges between 45° to 90°.

5. The single-cylinder cylinder head of claim 1, wherein the fourth cylinder mounting hole and the fifth cylinder mounting hole are arranged on opposing sides with respect to the central axis such that a component accommodation space is provided at the pushrod side between the pushrod passage, the gas inlet channel system, the gas outlet channel system, the fourth cylinder mounting hole, and the fifth cylinder mounting hole.

6. The single-cylinder cylinder head of claim 5, further comprising:

at least one component recess provided in the component accommodation space and connected to a component opening in the circular cylinder closing face; and a fuel channel system at least partially provided within the component accommodation space.

7. The single-cylinder cylinder head of claim 1, wherein the first cylinder mounting hole and the second cylinder mounting hole are positioned on either side of the gas inlet channel system, and the first cylinder mounting hole and the third cylinder mounting hole are positioned on either side of the gas outlet channel system.

8. The single-cylinder cylinder head of claim 1, wherein each cylinder mounting hole of the in total exactly five cylinder mounting holes has a cylinder mounting hole diameter ranging between 30 mm to 60 mm.

9. The single-cylinder cylinder head of claim 1, wherein an arc angle (γ) with respect to the central injector recess at the gas system side between the second cylinder mounting hole and the third cylinder mounting hole is greater than an arc angle (δ) with respect to the central injector recess at the pushrod side between the fourth cylinder mounting hole and the fifth cylinder mounting hole.

10. The single-cylinder cylinder head of claim 1, wherein an arc angle (ε) with respect to the central injector recess from the gas system side to the pushrod side between the second cylinder mounting hole and the fourth cylinder mounting hole is greater than an arc angle (ζ) with respect to the central injector recess from the pushrod side to the gas system side between the fifth cylinder mounting hole and the second cylinder mounting hole.

11. An engine comprising:

an engine block having a plurality of cylinder sections, each cylinder section of the plurality of cylinder sections having in total exactly five cylinder head mounting structures; and a plurality of single-cylinder cylinder heads, each single-cylinder cylinder head of the plurality of single-cylinder cylinder heads including in total exactly five cylinder mounting holes, wherein each single-cylinder cylinder head is mounted onto a respective cylinder section of the engine block via mounting members connecting the cylinder mounting holes of a respective single-cylinder cylinder head to the cylinder head mounting structures of a respective cylinder section of the engine block, wherein each single-cylinder cylinder head includes:

a cylinder head body having a gas system side, a pushrod side opposing the gas system side, a circular cylinder closing face with a central injector opening, a pair of inlet openings, and a pair of outlet openings, wherein the central injector opening is disposed centrally in the circular cylinder closing face and a central axis passes through the central injector opening from the gas system side to the pushrod side, and the pair of outlet openings and the pair of inlet openings are arranged on opposing sides with respect to the central axis;

a central injector recess extending through the cylinder head body to the central injector opening;

a gas inlet channel system extending from the gas system side through the cylinder head body to the pair of inlet openings;

a gas outlet channel system extending from the pair of outlet openings through the cylinder head body to the gas system side; and a pushrod passage extending through the cylinder head body at the pushrod side;

wherein the in total exactly five cylinder mounting holes extend through the cylinder head body in an outer circumferential region of the single-cylinder cylinder head, and wherein the in total exactly five cylinder mounting holes are non-equidistantly arranged around the central injector recess, and wherein the in total exactly five cylinder mounting holes include a first cylinder mounting hole, a second cylinder mounting hole, a third cylinder mounting hole, a fourth cylinder mounting hole, and a fifth cylinder mounting hole such that the first cylinder mounting hole is disposed between the gas inlet channel system and the gas outlet channel system at the gas system side, the second cylinder mounting hole and the third cylinder mounting hole are disposed on opposing sides with respect to the central axis at the gas system side, and the fourth cylinder mounting hole and the fifth cylinder mounting hole are disposed on opposing sides with respect to the central axis at the pushrod side.

12. The engine of claim 11, wherein the cylinder mounting holes are non-equidistantly arranged with respect to each other, and the cylinder mounting holes are non-equidistantly arranged with respect to the central injector recess.

13. The engine of claim 11, wherein the plurality of cylinder sections includes a first cylinder section and a second cylinder section, the in total exactly five cylinder head mounting structures of the first cylinder section is a first set of cylinder head mounting structures, the in total exactly five cylinder head mounting structures of the second cylinder section is a second set of cylinder head mounting structures, and a first circle passing through at least one cylinder head mounting structure of the first set of cylinder head mounting structures overlaps with a second circle passing through at least one cylinder head mounting structure of the second set of cylinder head mounting structures.

14. The engine of claim 11, wherein the in total exactly five cylinder head mounting structures of each cylinder section are non-equidistantly arranged with respect to each other, and the in total exactly five cylinder head mounting structures of each cylinder section are non-equidistantly arranged with respect to the corresponding cylinder bore.

15. The engine of claim 11, wherein each cylinder section further comprises a gas system side and a pushrod side opposing the gas system side, wherein the in total exactly five cylinder head mounting structures for each cylinder section includes a first cylinder head mounting structure, a second cylinder head mounting structure, a third cylinder head mounting structure, a fourth cylinder head mounting structure, and a fifth cylinder head mounting structure, wherein the first cylinder head mounting structure, the second cylinder head mounting structure, and the third cylinder head mounting structure are disposed at the gas system side, and the first cylinder head mounting structure is arranged between the second cylinder head mounting structure and the third cylinder head mounting structure, wherein the fourth cylinder head mounting structure and the fifth cylinder head mounting structure are disposed at the pushrod side, and wherein at least one of a first arc angle with respect to the cylinder bore at the gas system side between the first cylinder head mounting structure and the second cylinder head mounting structure is greater than a second arc angle with respect to the cylinder bore at the gas system side between the first cylinder head mounting structure and the third cylinder head mounting structure, a third arc angle with respect to the cylinder bore at the gas system side between the second cylinder head mounting structure and the third cylinder head mounting structure is greater than a fourth arc angle with respect to the cylinder bore at the pushrod side between the fourth cylinder head mounting structure and the fifth cylinder head mounting structure, and a fifth arc angle with respect to the cylinder bore from the gas system side to the pushrod side between the second cylinder head mounting structure and the fourth cylinder head mounting structure is greater than a sixth arc angle with respect to the cylinder bore from the pushrod side to the gas system side between the fifth cylinder head mounting structure and the second cylinder head mounting structure.

16. The engine block of claim 11, each cylinder head mounting structure of the in total exactly five cylinder head mounting structures is configured to receive a head bolt or a head stud.

* * * * *